United States Patent [19]

Campbell, Jr. et al.

[11] Patent Number: 4,896,717

[45] Date of Patent: Jan. 30, 1990

[54] FLUIDIZED BED REACTOR HAVING AN INTEGRATED RECYCLE HEAT EXCHANGER

[76] Inventors: Walter R. Campbell, Jr., 1659 Porter Rd., Union, N.J. 07083; Michael G. Alliston, 24 Field La., Denville, N.J. 07834; Benjamin H. Sisson, 267 Powder Horn Dr., Phillipsburg, N.J. 08865

[21] Appl. No.: 100,509

[22] Filed: Sep. 24, 1987

[51] Int. Cl.[4] ..... F28D 19/02; F28C 3/16

[52] U.S. Cl. ..... 165/104.18; 165/104.16; 110/245; 122/4 D

[58] Field of Search ..... 165/104.16, 104.18, 165/104.15; 110/245; 122/4 D

[56] References Cited

U.S. PATENT DOCUMENTS

| | | | |
|---|---|---|---|
| 3,893,426 | 7/1975 | Bryers . | |
| 4,253,425 | 3/1981 | Gamble . | |
| 4,594,967 | 6/1986 | Wolowodiuk | 165/104.16 |
| 4,617,877 | 10/1986 | Gamble . | |
| 4,672,918 | 6/1987 | Engstrom et al. | 122/4 D |
| 4,699,068 | 10/1987 | Engstrom | 110/245 |
| 4,716,856 | 1/1988 | Beisswenger et al. | 165/104.16 |

FOREIGN PATENT DOCUMENTS

| | | | |
|---|---|---|---|
| 41311 | 3/1980 | Japan | 122/4 D |

*Primary Examiner*—Albert W. Davis, Jr.

[57] ABSTRACT

A fluidized bed reactor in which a recycle heat exchanger is located adjacent the furnace of the reactor with each enclosing a fluidized bed and sharing a common wall including a plurality of water tubes. A mixture of flue gases and entrained particulate materials from the fluidized bed in the furnace are separated and the flue gases are passed to a heat recovery area and the separated particulate material to the fluidized bed in the recycle heat exchanger. The bed materials in the fluidized bed in the recycle heat exchanger are passed to the fluidized bed in the furnace. Steam is generated, superheated and reheated in the heat exchange surfaces, including water wall tubes, in the furnace, the recycle heat exchanger, and the heat recovery area.

2 Claims, 1 Drawing Sheet

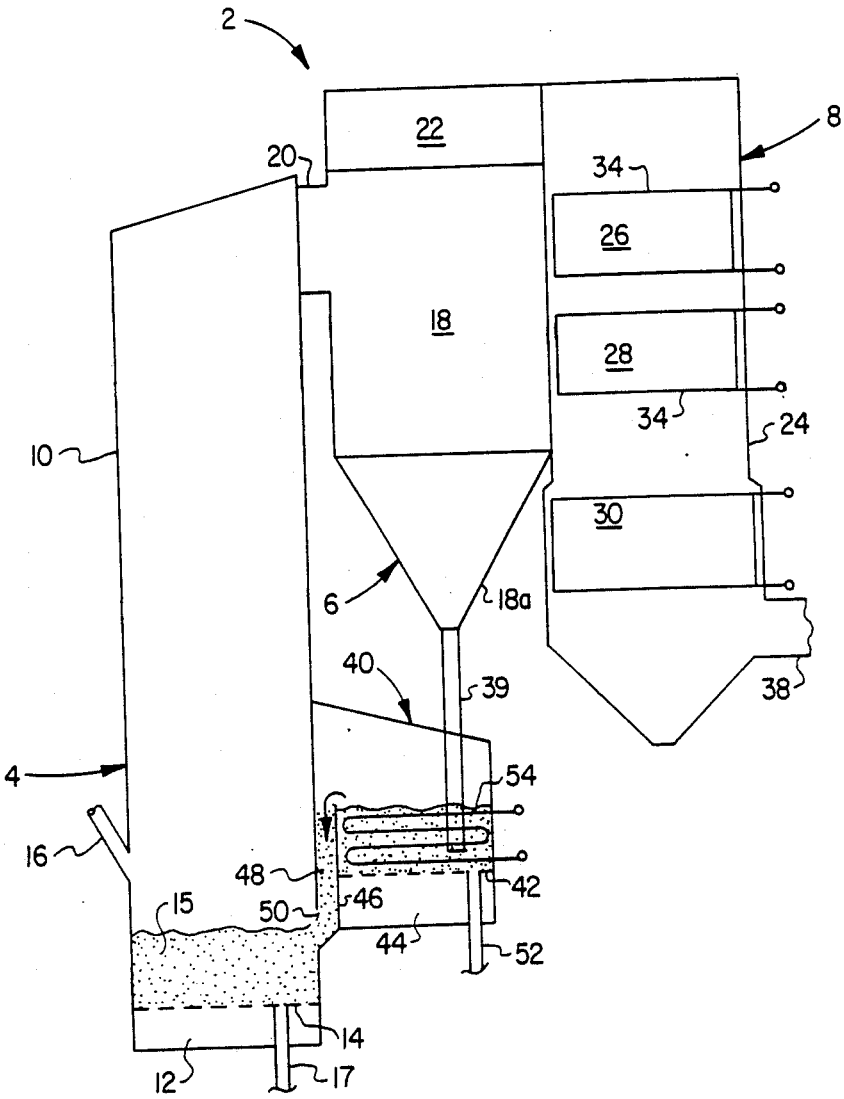
2
22
8
20
34
26
18
28
34
24
10
30
6
18a
40
39
38
4
54
16
48
42
15
50
46
44
52
14
12
17

FLUIDIZED BED REACTOR HAVING AN INTEGRATED RECYCLE HEAT EXCHANGER

BACKGROUND OF THE INVENTION

This invention relates to a fluidized bed reactor and a method of operating same and, more Particularly, to such a reactor and method in which a recycle heat exchanger is formed integrally with the steam generator.

Fluidized bed reactors, such as gasifiers, steam generators, combustors, and the like, are well known. In these arrangements, air is passed through a bed of particulate material, including a fossil fuel such as coal and an adsorbent for the sulfur generated as a result of combustion of the coal, to fluidize the bed and to promote the combustion of the fuel at a relatively low temperature. The entrained particulate solids are separated externally of the bed and recycled back into the bed. The heat produced by the fluidized bed is utilized in various applications such as the generation of steam, which results in an attractive combination of high heat release, high sulfur adsorption, low nitrogen oxides emissions and fuel flexibility.

The most typical fluidized bed reactor is commonly referred to as a "bubbling" fluidized bed in which the bed of particulate material has a relatively high density and a well-defined, or discrete, upper surface.

Other types of fluidized bed reactors utilize a "circulating" fluidized bed. According to these processes, the fluidized bed density is well below that of a typical bubbling fluidized bed, the air velocity is greater than that of a bubbling bed or the flue gases passing through the bed entrain a substantial amount of particulate solids and are substantially saturated therewith.

Also, circulating fluidized beds are characterized by relatively high solids recycling which makes it insensitive to fuel heat release patterns, thus minimizing temperature variations, and therefore, stabilizing the emissions at a low level. The high solids recycling improves the efficiency of the mechanical device used to separate the gas from the solids for solids recycle, and the resulting increase in sulfur adsorbent and fuel residence times reduces the adsorbent and fuel consumption.

However, several problems do exist in connection with these types of fluidized bed reactors, and more particularly, those of the circulating type. For example, a sealing device such as a seal pot, a syphon seal, or an "L" valve and a hot expansion joint are required between the low pressure cyclone discharge and the higher pressure furnace section of the reactor, and the transfer of the separated particulate material from the cyclone back to the fluidized bed furnace has to be done by a gravity chute or a pneumatic transport system. The addition of these components add to the cost and complexity of the system. Also in these types of reactors the particulate material recycled from the cyclone to the fluidized bed furnace has to be at a fairly precise temperature. This requires an increased furnace height or the installation of wear-prone surfaces in the upper furnace to cool the particulate material before being reinjected into the fluidized bed to the appropriate temperature. This causes the furnace exit flue gases to be cooled to the point where the efficiency of the downstream convection heat exchange surfaces suffer and extra surfaces are required since the heat recovery area requires the installation of all the reheat and superheat surfaces. Further, a hot expansion joint is required between the outlet of the cyclone and the inlet to the fluidized bed furnace which is subjected to positive pressure, a distinct disadvantage.

SUMMARY OF THE INVENTION

It is therefore an object of the present invention to provide a fluidized bed reactor and method for controlling same which overcomes the aforementioned disadvantages of previous techniques.

It is a further object of the present invention to provide a reactor and method of the above type which eliminates the need for pneumatic transport devices between the separator and the furnace section of the reactor.

It is still further object of the present invention to provide a reactor and method of the above type in which the height of the furnace section of the reactor is reduced and the need for wear-prone surfaces in the upper furnace section is eliminated.

It is a still further object of the present invention to provide a reactor and method of the above type in which radiant superheater and/or reheater surfaces in the upper portion of the furnace is eliminated.

It is a still further object of the present invention to provide a reactor and method of the above type in which the efficiency of the heat exchange surfaces is increased.

It is a still further object of the present invention to provide a reactor and method of the above type in which optimum bed temperatures are achieved.

Toward the fulfillment of these and other objects, the fluidized bed reactor of the present invention includes a heat exchange section located adjacent the furnace section of the reactor with each section containing a fluidized bed and sharing a common wall including a plurality of water tubes. The flue gases and entrained particulate materials from the fluidized bed in the furnace section are separated and the flue gases are passed to the heat recovery area and the separated particulate material is passed to the recycle heat exchanger. The bed material in the recycle heat exchanger is passed to the fluidized bed in the furnace. Boiler water is passed through wall tubes where steam is generated.

BRIEF DESCRIPTION OF THE DRAWINGS

The above brief description, as well as further objects, features and advantages of the present invention will be more fully appreciated by reference to the following detailed description of the Presently preferred but nonetheless illustrative embodiments in accordance with the present invention when taken in conjunction with the accompanying drawing which is a schematic representation depicting the system of the present invention.

DESCRIPTION OF THE PREFERRED EMBODIMENT

Referring specifically to the drawing, the reference numeral 2 refers, in general, to a fluidized bed reactor which includes a furnace section 4, a separating section 6, and a heat recovery area 8. The furnace section 4 includes an upright enclosure 10 and an air plenum 12 disposed at the lower end portion of the enclosure for receiving air from an external source. An air distributor 14 is provided at the interface between the lower end of the enclosure 10 and the air plenum 12 for allowing the pressurized air from the plenum to pass upwardly through the enclosure 10. A bed 15 of particulate material is supported on the air distributor 14 and one or more inlets 16 are provided through the front wall of the enclosure 10 for introducing a particulate material onto the bed, and a drain pipe 17 registers with an opening in the air distributor 14 for discharging spent particulate material from the bed 15. The particulate material can include coal and relatively fine particles of an adsorbent material, such as limestone, for adsorbing the sulfur generated during the combustion of the coal, in a known manner. The air from the plenum 12 fluidizes the particulate material in the bed 15.

It is understood that the walls of the enclosure 10 include a plurality of water tubes disposed in a vertically extending relationship and that flow circuitry (not shown) is provided to pass water through the tubes to convert the water to steam. Since the construction of the walls of the enclosure 10 is conventional, the walls will not be described in any further detail.

The separating section 6 includes one or more cyclone separators 18 provided adjacent the enclosure 10 and connection thereto by ducts 20 which extend from openings formed in the upper portion of the rear wall of the enclosure 10 to inlet openings formed in the upper portion of the separators 18. The separators 18 receive the flue gases and entrained particulate material from the fluidized bed 15 in the enclosure 10 and operate in a conventional manner to disengage the particulate material from the flue gases due to the centrifugal forces created in the separator. The separated flue gases pass, via ducts 22, into and through the heat recovery area 8.

The heat recovery area 8 includes an enclosure 24 housing superheater 26, a reheater 28 and an economizer 30, all of which are formed by a plurality of heat exchange tubes 34 extending in the path of the gases that pass through the enclosure 24. The superheater 26, the reheater 28 and the economizer 30 all are connected to fluid flow circuitry (not shown) extending from the tubes forming the walls of the furnace section 10 to receive heated water or vapor for further heating. It is understood that the tubes 34 are formed in bundles, in a conventional manner.

After passing through the superheater 26, the reheater 28 and the economizer 30, the gases exit the enclosure 24 through an outlet 38 formed in the rear wall thereof.

The separated solids from the separator 18 pass into a hopper **18*a* connected to the lower end of the separator and then into a dipleg 39 connected to the outlet of the hopper. The dipleg 39 extends into a relatively small enclosure 40 disposed adjacent the lower rear wall portion of the enclosure 10 for receiving particulate material from the dipleg. An air distributor 42 is disposed at the lower end portion of the enclosure 40 and defines an air plenum 44 to introduce air received from an external source into and through the air distributor 42 and into the interior of the enclosure. A partition 46 extends between rear wall of the enclosure 10 and the air distributor 44 to define a passage 48 which registers with an opening 50 formed in the latter rear wall to allow the particulate material from the vessel 40 to overflow and pass into the interior of the enclosure 10 and into the bed 15. A drain pipe 52 discharges the spent particulate material from the enclosure and a bundle of heat exchange tubes 54 are disposed in the enclosure 40 for circulating a cooling fluid, such as water through the interior of the enclosure 40 to cool the bed of particulate material on the air distributor 42**.

According to a feature of the present invention, the lower rear wall portion of the enclosure 10 serves as a common wall for the enclosure 40 and, as such, forms the front wall of the latter enclosure. It is understood that the remaining walls of the enclosure 40 can include water tubes in the manner described in connection with the walls of the enclosure 10.

In operation, particulate fuel material from the inlet 16 is introduced into the enclosure 10 and adsorbent material can also be introduced in a similar manner, as needed. Pressurized air from an external source passes into and through the air plenum 12, through the air distributor 14 and into the bed 15 of particulate material in the enclosure 10 to fluidize the material.

A lightoff burner (not shown), or the like, is disposed in the enclosure 10 and is fired to ignite the particulate fuel material. When the temperature of the material reaches a relatively high level, additional fuel from the inlet 16 is discharged into the enclosure 10.

The material in the enclosure 10 is self-combusted by the heat in the furnace section 10 and the mixture of air and gaseous products of combustion (hereinafter referred to as "flue gases") passes upwardly through the enclosure 10 and entrain, or elutriate, the relatively fine particulate material in the enclosure. The velocity of the air introduced, via the air plenum 12, through the air distributor 14 and into the interior of the enclosure 10 is established in accordance with the size of the particulate material in the enclosure 10 so that a circulating fluidized bed is formed, i.e. the particulate material is fluidized to an extent that substantial entrainment or elutriation of the particulate material in the bed is achieved. Thus the flue gases passing into the upper portion of the enclosure 10 are substantially saturated with the particulate material. The saturated flue gases pass to the upper portion of the enclosure 10 and exit through the ducts 20 and pass into the cyclone separators 18. In the separators 18, the solid particulate material is separated from the flue gases and the former passes through the hoppers **18*a* and is injected, via the diplegs 39, into the enclosure 40. The cleaned flue gases from the separators 18 exit, via the duct 22, to the heat recovery area 8 for passage through the enclosure 24 and across the superheater 26, the reheater 28 and the economizer 30, before exiting through the outlet 38** to external equipment.

In the enclosure 40, the temperature of the separated solids accumulating on the air distributor 44 is controlled by the fluid circulating through the tubes 52. These solids overflow the enclosure 40 and pass, via the passage 48, through the opening 50 in the rear wall of the enclosure 10 and into the fluidized bed 15 where they mix with the other solids in the bed. Air is injected, via the plenum 44 and the air distributor 42 to fluidize the particulate material in the enclosure 40 and seal against a backflow of flue gases from the enclosure 10 through the passage 48 and the dipleg 39 and into the separator 18 in a direction opposite from the normal system flow described above.

Water is passed through the economizer 30, to the steam drum 32, then through the walls of the furnace section 10 to exchange heat with the fluidized bed 15 and generate steam. The steam then passes through fluid flow circuitry (not shown) to the bundles of tubes 34 forming the superheater 26, the reheater 28 and the economizer 30 in the heat recovery area 8. The steam thus picks up additional heat from the hot gases passing through the heat recovery area 8 before the steam is discharged to external equipment such as a steam turbine.

It is thus apparent that several advantages result from the foregoing. The use of sealing devices, and pneumatic transport devices between the cyclone separator solids outlet and the furnace section of the reactor are eliminated. Also, the height of the furnace section of the reactor is reduced and the need for wear-prone surfaces in the upper furnace section is eliminated. Further, the radiant superheater and/or reheater surface in the upper portion of the furnace is eliminated and the efficiency of the downstream heat exchange surfaces is increased. Still further, optimum bed temperatures are achieved.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed combustion system including a furnace, a fluidized bed of combustible particulate material disposed in the furnace, a recycle heat exchanger disposed adjacent said furnace and sharing a common wall with said furnace separating means for receiving a mixture of flue gases and entrained particulate material from a fluidized bed in said furnace and separating said particulate material from said flue gases, means for passing said separated flue gases to a heat recovery area, means for passing said separated particulate material to said heat exchanger, and a vertical partition disposed in said heat exchanger for dividing said heat exchanger into a chamber for receiving said separated particulate material and a vertically extending passage located between said common wall and said chamber for receiving said particulate material from said chamber, means for distributing air through said material in said chamber to fluidize said latter material, heat exchange means disposed in said chamber for passing fluid through said material in said chamber to control the temperature of said material, said common wall having an opening extending therethrough and registering with the lower end of said passage for passing said material from said passage to said fluidized bed in said furnace, the height of particulate material in said passage being sufficient to seal against backflow of said flue gases from said furnace through said heat exchanger and to said separating means.

2. The system of claim 1 wherein said separating means comprises an outlet pipe extending into the material in said chamber of said heat exchanger.

* * * * *